US005593036A

United States Patent [19]

Dyble et al.

[11] Patent Number: 5,593,036

[45] Date of Patent: Jan. 14, 1997

[54] LOCKING PACKAGE

[75] Inventors: Richard J. Dyble; Timothy M. Stirmel, both of Janesville, Wis.

[73] Assignee: Panoramic, Inc., Janesville, Wis.

[21] Appl. No.: 552,057

[22] Filed: Nov. 2, 1995

[51] Int. Cl.[6] ..... B65D 73/00

[52] U.S. Cl. ..... 206/464; 206/348; 206/462; 206/470; 220/326

[58] Field of Search ..... 206/1.5, 348, 461, 206/462, 464, 465, 467, 470, 471; 220/346

[56] References Cited

U.S. PATENT DOCUMENTS

| | | | |
|---|---|---|---|
| 2,529,128 | 11/1950 | Bergstein | 229/23 |
| 3,404,774 | 10/1968 | Levine | 206/78 |
| 3,608,705 | 9/1971 | Moshel | 206/95.34 |
| 3,746,242 | 7/1973 | Troth | 206/45.34 |
| 3,904,029 | 9/1975 | Koltz | 206/45.34 |
| 3,985,232 | 10/1976 | Johnson | 206/461 |
| 4,119,203 | 10/1978 | Kuchenbecker | 206/461 |
| 4,858,756 | 8/1989 | Herrin et al. | 206/45.34 |
| 5,069,334 | 12/1991 | Herrin et al. | 206/45.34 |
| 5,117,972 | 6/1992 | Herrin et al. | 206/45.34 |
| 5,121,835 | 6/1992 | Grupe | 206/461 |

*Primary Examiner*—Paul T. Sewell
*Assistant Examiner*—Luan K. Bui
*Attorney, Agent, or Firm*—Foley & Lardner

[57] ABSTRACT

A locking package is provided including a product holding member mounted to a graphics card. The product holding member is preferably made of semi-rigid clear plastic and includes a product holding portion, a pair of flanges forming card retaining channels on opposite sides of the product holding member, and hinged locking snaps. The flanges may be foldover flanges formed by heating and folding over the edge of the product holding member along cut score lines. The hinged snap locks preferably include a first raised portion, on one side of a hinge, and a second corresponding raised portion, on the opposite side of the hinge, which interlock, one inside the other, when the hinged snap lock is folded over at the hinge. The graphics card is preferably made of paperboard and includes an internal edge defining a locking hole. The graphics card is secured to the product holding member by sliding the graphics card into the channels formed by the flanges of the product holding member, to close the back of the product holding portion to form a product holding chamber, and closing the hinged snap locks to secure the card in place by engaging the snaps to the locking hole on the card. Glue or heat sealing is not required to form the locking package.

19 Claims, 4 Drawing Sheets

LOCKING PACKAGE

FIELD OF THE INVENTION

This invention relates generally to packages having clear plastic product holding members mounted on paperboard cards.

BACKGROUND OF THE INVENTION

Packages having plastic product holding members mounted to paperboard graphics cards are well known in the prior art. A typical example of such a package is the blister card package. This type of package has a clear plastic blister, or product holding member, which is glued, or otherwise adhered, to a paperboard card backing. The blister has a raised product holding portion which is typically used for holding one or more products for retail display. The graphics card backing provides a back to close the blister, provides support for the product holding member, and typically includes graphic illustrations and written information pertaining to the product to be held in the product holding portion of the product holding member. To open such a package, the product holding member is torn away from the paperboard backing, to open the back of the product holding member, either by breaking the adhesive bond between the product holding member and the paperboard card, or by ply separation of the paperboard card. Thus, opening a blister package is messy and effectively destroys the package. Since the blister package cannot be re-sealed, a product contained in such a package cannot practically be removed from the package for demonstration to a potential buyer.

Another disadvantage of blister card type packages is that the package cannot be completed until the product to be contained is inserted in the blister, after which the card is glued or heat sealed to the plastic blister. This last operation typically requires gluing or sealing equipment, and may have to be done at other than the most convenient location. For example, products would typically have to be shipped from the product manufacturer to the package manufacturer for packaging. Alternatively, the blister card package components could be shipped from the package manufacturer to the product manufacturers for completion of the packaging process, but this would require the product manufacturer to maintain and operate the required specialized gluing or heat sealing equipment.

A third disadvantage of the blister card type package is that gluing or heat sealing of the card can damage and obscure decoration or writing on the card around the blister. This limits the available card space for product promotion and can negatively affect the appearance of the package which can also detract from the product contained therein.

A prior art container structure which overcomes some of the disadvantages of blister card packages is a basic box structure having paperboard portions and clear plastic portions for displaying a product contained in the box. The assembly of such box structures, however, typically requires multiple folding and gluing operations which must be performed manually, or, more typically, using specialized machinery.

SUMMARY OF THE INVENTION

A locking package in accordance with the present invention includes a product holding member secured to a graphics card. The graphics card may be secured to the product holding member without the use of glue or heat sealing.

Thus, products may be sealed in the package at a convenient location without the need for specialized gluing or heat sealing equipment.

The product holding member is preferably made of clear semi-rigid plastic, and includes a product holding portion, a card display portion, a pair of flanges on opposite sides of the product holding member forming channels for receiving a graphics card, and at least one hinged flap with a snap lock for securing the graphics card to the product holding member by passing through a locking hole in the graphics card. The flanges may be formed as foldover flanges by cutting a score line near the edge of the product holding member and then applying heat and folding over the edge on the score line to form the flange. The use of a score line is not required, however. The hinged flap and snap preferably includes a first raised portion of the product holding member on one side of a hinged portion of the product holding member, and a second and complimentary raised portion on the opposite side of the hinge from the first raised portion. The raised portions are formed on opposite faces of the product holding member so that, when the flap is bent over at the hinge, the first raised portion will fit tightly inside a cavity formed by the second raised portion. The sidewalls of the raised portions may preferably be angled slightly so that the raised portions may be more securely snapped together, one inside the other.

The graphics card is preferably a die-cut paperboard card, which may include graphic illustrations and written information pertaining to a product to be held in the product holding portion of the locking package. The graphics card is die-cut to form an internal edge which defines a locking hole which corresponds to the first raised portion of the product holding member hinged flap and snap lock. The graphics card is used to form a backing for the locking package, to close the back of the product holding portion to enclose a product therein, and to provide product information.

To assemble the locking package of the present invention, the graphics card is slid under the flanges of the product holding member into the card retaining channels formed by the flanges. The locking hole of the graphics card is aligned with the first raised portion of the snap. The hinged flap and snap lock is then folded over at the hinge such that the first raised portion interlocks into the cavity formed by the second raised portion and the snap lock is engaged through the locking hole in the graphics card. With the raised portions of the snap lock snapped securely together, the graphics card is held securely in place to the product holding member by the flanges and the snap lock. The graphics card thus forms the back of the package, closing the product holding portion of the product holding member to enclose a product therein, without the need for glue or heat sealing. To further secure the locking package, the joined raised portions of the snap lock may be slightly crushed or ultrasonically sealed to lock them together.

Further objects, features and advantages of the invention will be apparent from the following detailed description taken in conjunction with the accompanying drawings.

DETAILED DESCRIPTION OF THE INVENTION

Figure 1:
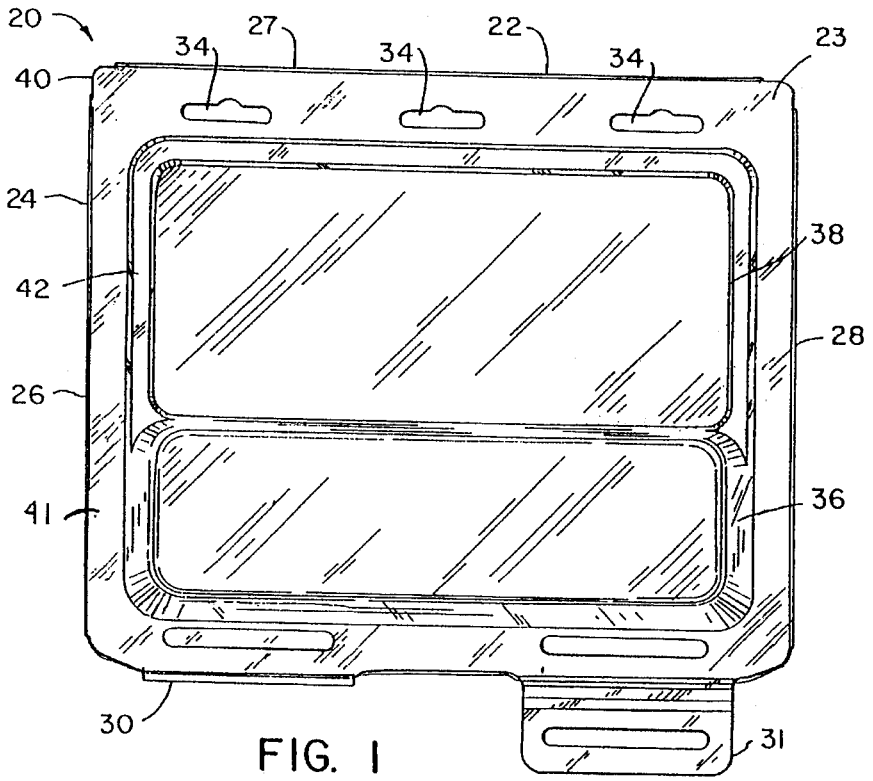
FIG. 1 is a front view of a locking package in accordance with the present invention.

A locking package in accordance with the present invention is shown generally at 20 in FIG. 1. The locking package 20 includes a product holding member 22 having a front side 23 and a graphics card 24. In the view of FIG. 1, the graphics card 24 is located entirely behind the product holding member 22. The graphics card 24 is secured to the product holding member 22 by flanges 26, and 28, and hinged flaps and snap locks 30 (shown closed) and 31 (shown open), which are integrally formed portions of the product holding member 22, and which will be described in more detail below. Note that only a single hinged flap snap lock is required to secure the graphics card back 24 into place. A third flange 27 may also be used to provide an additional channel to support the graphics card 24. One or more internal edges may be formed on the product holding member 22 and graphics card 24 to define hang holes 34 which extend through the product holding member 22 and the graphics card 24 and whereby the locking package 20 may be suspended for display of the locking package 20 and its contents in a retail setting.

The product holding member 22 includes a raised product holding portion 36 and a card display portion 38. The product holding portion 36 is a portion of the product holding member 22 in which the front side 23 of the product holding member 22 is raised from the plane of the graphics card 24 to provide space for holding one or more products. When the locking package 20 is assembled, the graphics card provides a back to the product holding portion 36 to form a closed chamber to hold the product or products placed therein. The card display portion 38 of the product holding member 22 is a portion of the product holding member 22 wherein the front side 23 of the product holding member 22 is close to the plane of the graphics card 24 such that graphic illustrations or written descriptions on the graphics card 24 may be easily viewed through the card viewing portion 38 of the product holding member 22. The relative sizes of the portions of the front face 23 of the product holding member 22 which define the product holding portion 36 and the card display portion 38 will depend on the nature and size of the product to be contained in the locking package 20 and in the information to be displayed on the graphics card 24. Thus, in some cases, the product holding portion 36 may extend to include almost the entire front side 23 of the product holding member 22.

The product holding portion 36 is recessed from the edge 40 of the product holding member 22. Thus, a frame 41 is formed around the edge 40 of the product holding member 22. As assembled, the graphics card 24 rests against the back of the frame 41 to form the back of the locking package 20. Unlike in a typical blister type package, however, the card 24 need not be glued or otherwise sealed to the frame 41. Where the card display portion 38 is relatively large, a raised ridge portion 42 on the front face 23 of the product holding member 22, extending around the card display portion 38, may preferably be used to increase the rigidity of the product holding member 22. The frame 41 would also extend between the raised ridge 42 and the edge 40 of the product holding member 22.

Figure 2:
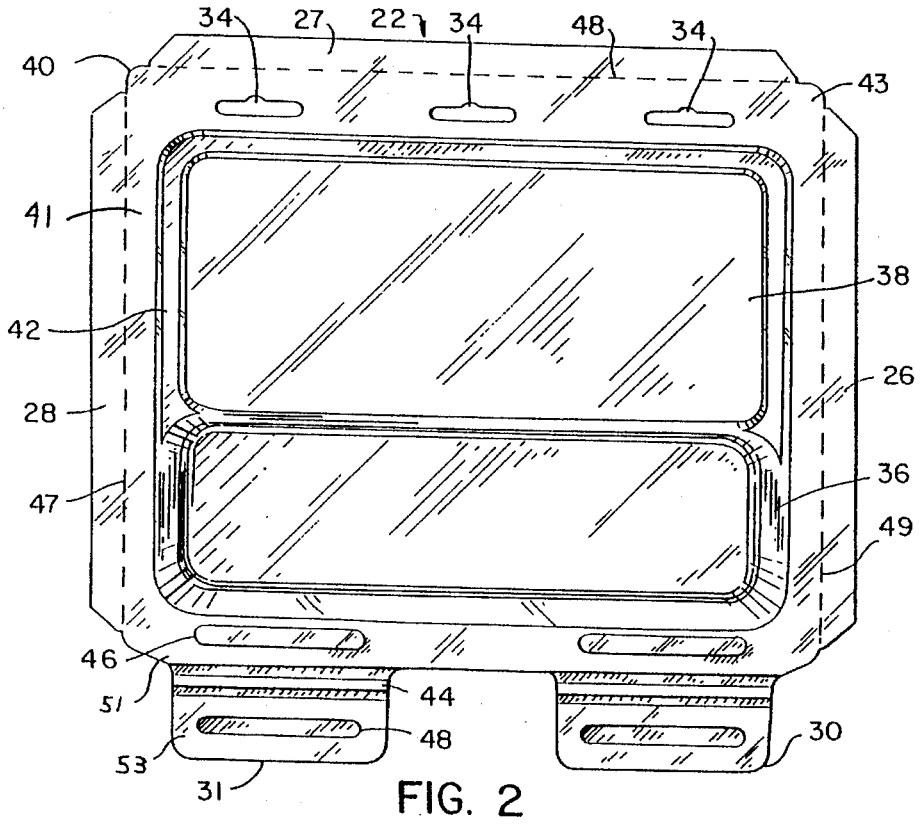
FIG. 2 is a back view of a product holding member for the locking package of the present invention with foldover flanges shown before being folded over.
Figure 3:
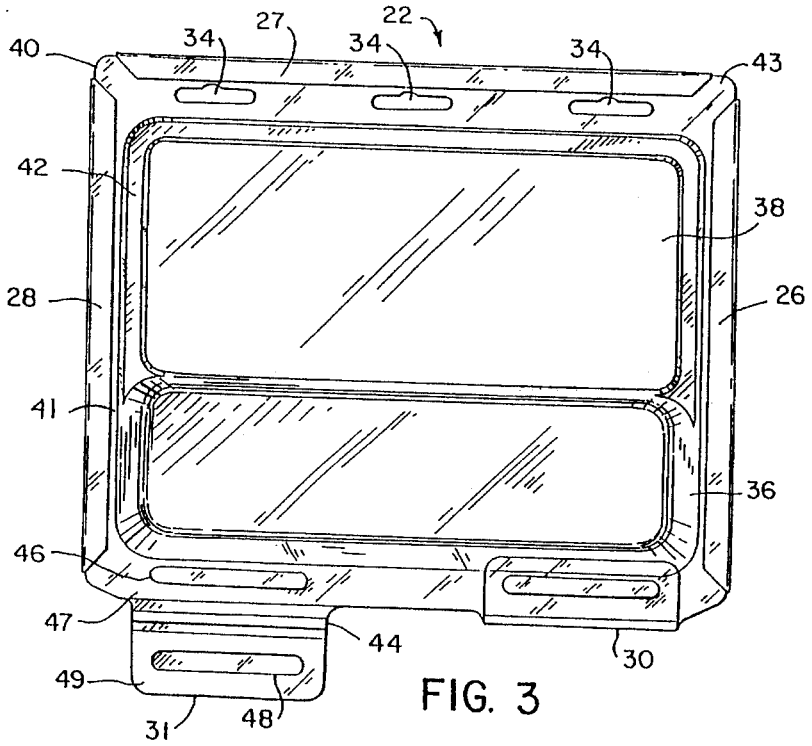
FIG. 3 is a back view of the product holding member of FIG. 2 with the foldover flanges folded over.

The product holding member 22 is described in more detail with reference to FIG. 2, showing a view of the back side 43 of the product holding member 22. The product holding member 22 is preferably made of a semi-rigid clear plastic material, such as R-PVC. However, it is clear that other materials, including opaque or colored plastic, could also be used to form the product holding member 22. The product holding member 22 is preferably a molded product with the mold contours defining the product holding portion 36, the card display portion 38, the raised ridge 42, and the raised components of the hinged flap and snap locks 30 and 31 including the hinge 44, a first raised portion 46 and a second raised portion 48. The hinged flaps and snap locks 30 and 31 are identical and, therefore, only the structural components of one of the hinged snaps 30 will be labeled throughout the remainder of the figures. The construction and operation of the hinged flaps and snap locks 30 and 31 will be described in more detail below.

The product holding member 22 is preferably molded without the flanges 26, 27, and 28, fully formed. The use of foldover flanges greatly simplifies the production of the product holding member 22. After the product holding member 22 is removed from the mold, score lines 47, 48, and 49 may be cut along the back side 43 of the product holding member 22 near the edge 40 of the product holding member 22 to define the foldover flanges 26, 27, and 28. The edge of the product holding member 22 may then be heated and folded toward the back side 43 of the product holding member 22 along the cut score lines 47, 48, and 49, to form the folded over flanges 26, 27, and 28, respectively. The flanges 26, 27, and 28 may be similarly formed without use of the score lines 47, 48, and 49. In addition, the flanges 26, 27 and 28 need not be made using the foldover technique to be in accordance with the present invention. Any other known method of forming the flanges may be used. The flanges form channels between the flanges and the back of the frame 41 in which the graphics card may be inserted and retained. Note that more or fewer than three flanges may be formed in this manner. At least two flanges 26 and 28, forming two channels on opposite sides of the product holding member 22, are required, however, to secure the graphics card 24 to the product holding member 22 to form the locking package 20 in accordance with the present invention.

Figure 4:
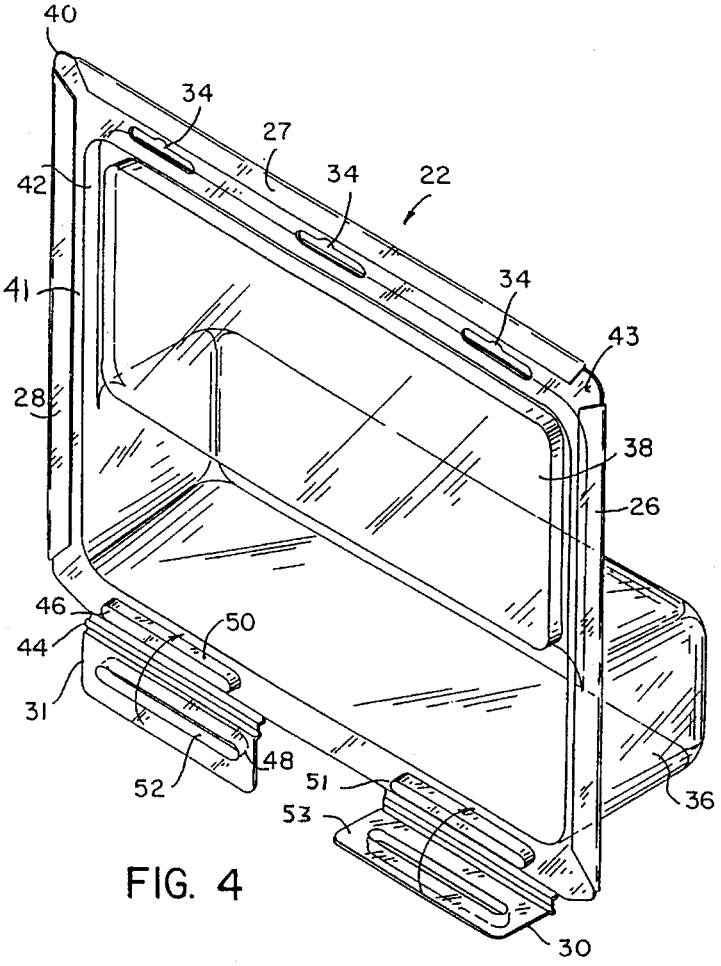
FIG. 4 is a back perspective view of the product holding member of FIG. 3.
Figure 5:
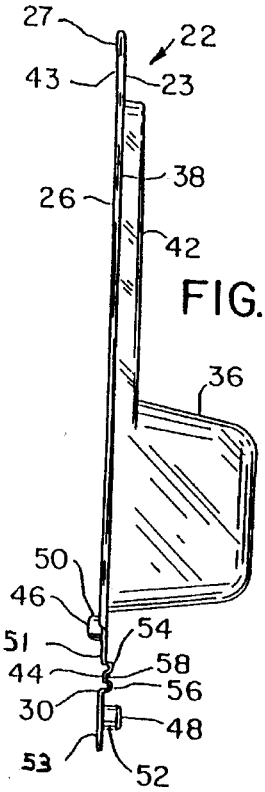
FIG. 5 is a side view of the product holding member of FIG. 3 showing the hinged snap lock of the present invention in an open position.

A complete product holding member 22, with folded over flanges 26, 27, and 28, is shown in the several views of FIGS. 3–6, wherein like numerals refer to like parts throughout the several views. The product holding member 22 is shown having a pair of hinged flaps and snap locks 30 and 31 (in FIG. 3 hinged flap and snap lock 30 is shown closed and hinged flap and snap lock 31 is shown open). More or fewer hinged flaps and snap locks may be used in accordance with the present invention. Thus, a locking package 20 having a single hinged snap 30 may be in accordance with the present invention. As best illustrated in FIGS. 4 and 5, the hinged flap and snap lock 30 includes a first raised portion of the product holding member 46, a second raised portion 48, and a hinge structure 44 between the first raised portion 46 and the second raised portion 48. The raised portions 46 and 48 may be of any corresponding size and shape. The first raised portion 46 is raised from the back side 43 of the product holding member 22 and has sidewalls 50. The area of the frame 41 of the back face 43 around the raised portion 46 may be defined as the first hinge plate area 51. The second raised portion 48 extends from the front side 23 of the product holding member 22 and has side walls 52 and corresponding hinge plate area 53. The second raised portion 48 thus forms a void or cavity in the back face 43 of the product holding member which corresponds to the first raised portion 48 to form the two inter-engaging sections of the snap lock.

Figure 6:
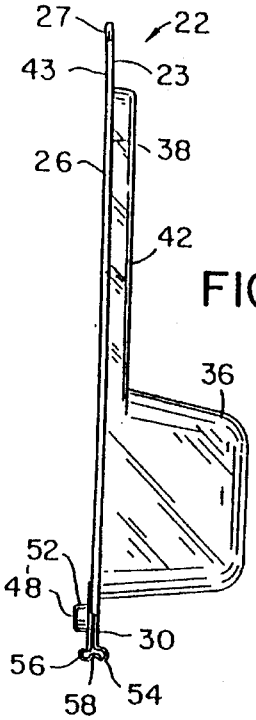
FIG. 6 is a side view of the product holding member of FIG. 3 showing the hinged snap lock of the present invention in a closed position.

When folded over at the hinge 44, as illustrated in FIG. 6, the outer surface of the wall 50 of the first raised portion 46 becomes engaged with the cavity formed by the inner surface of the wall 52 of the second raised portion 48. Preferably, the side walls 50 and 52 of the raised portions 46 and 48 are slightly tapered, e.g., at 5 degrees, such that the walls 50 and 52 flare outwardly slightly as they rise from the sides of the product holding member 22. (This angle can be seen more clearly in the detailed view of FIG. 10.) This allows the raised portions 46 and 48 to snap together more securely. Otherwise, the raised portions are held together by friction between their wall surfaces. Note that the raised portions may be interchanged with respect to the faces 23 and 43 of the product holding member 22. Thus, the first raised portion 46 may be raised from the front face 23 with the second raised portion raised from the back face 43, such that, when closed around the hinge 40, a cavity formed by the inner surface of the wall 50 of the first raised portion 46 will be engaged with the outer surface of the wall 52 of the second raised portion 48. This alternative embodiment of the present invention may easily be made using a mold with contours defining the alternative snap lock structures.

Preferably, the hinge 44 of the hinged flap snap lock 30 includes a first bending section 54 and a second bending section 56 separated by a separator section 58. The first and second bending sections 54 and 56 may preferably be implemented simply as raised rounded portions in what is the front face 23 of the product holding member 22. These may be formed by heating and bending the product holding member 22 in the appropriate places or may be formed as part of the molding process. As shown in FIG. 5, the bending sections 54 and 56 and separator section 58 form a hinge 44 which is essentially W-shaped in cross-section. The separator section 58 is preferably of a width approximately equal to that of the thickness of the graphics card 24 so that, when the hinged snap 30 is closed, a space remains between the hinge plate surfaces 51 and 53 to accommodate the graphics card 24.

Figure 7:
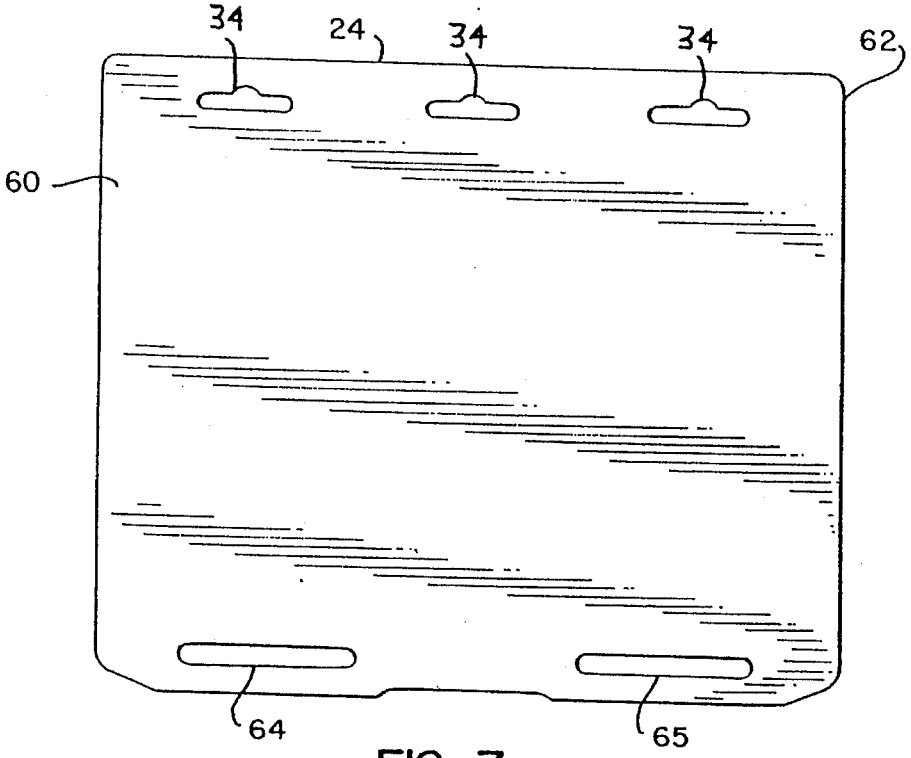
FIG. 7 is a plan view of a graphics card for the locking package of the present invention.

A plan view of the front face 60 of a graphics card 24 for the locking package 20 is shown in FIG. 7. The graphics card 24 is preferably made of a material such as paperboard, but may be made of other generally rigid materials, such as printed plastic, as well. The front face 60 of the graphics card 24 may include graphic illustrations and written materials concerning the product to be held in the product holding portion 36 of the product holding member 22. The back face 62 of the graphics card 24 may be similarly illustrated. If a paperboard graphics card 24 is used, the card 24 may preferably be die-cut to form the shape of the card 24, the internal edges defining the hang holes 34, and internal edges which define locking holes 64 and 65. The locking holes 64 and 65 are slightly larger than, but conform to the shape of, the raised portion 46 of the snap lock on the back face 43 of the product holding member 22.

Figure 8:
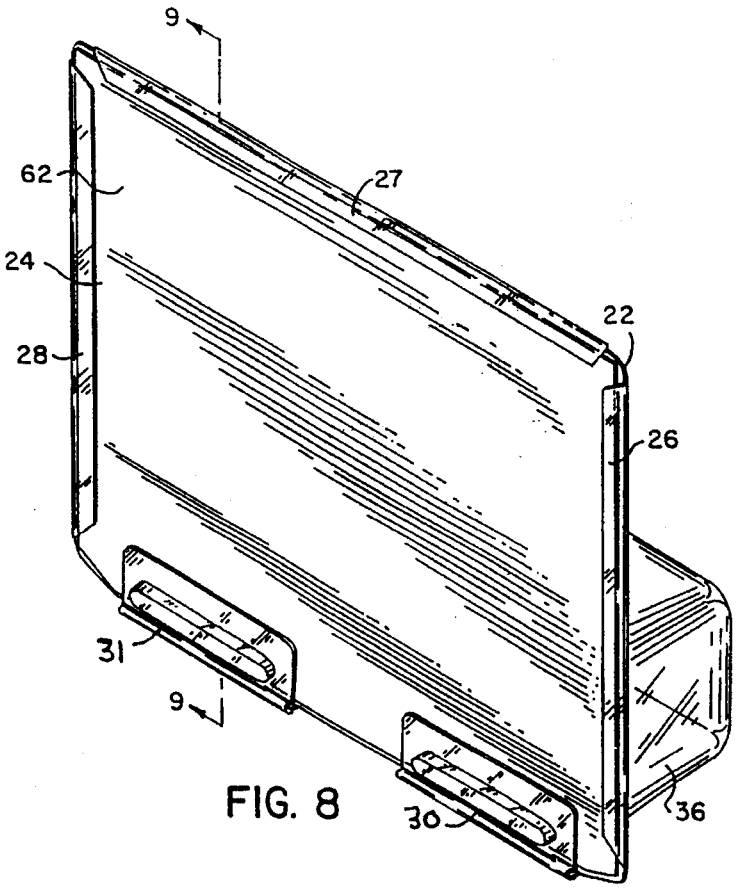
FIG. 8 is a back perspective view of the assembled locking package of the present invention including the graphics card and the product holding member secured together.
Figure 9:
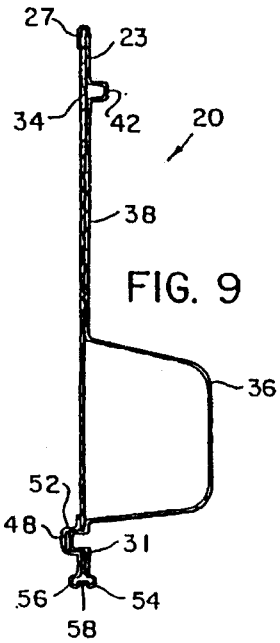
FIG. 9 is a cross-sectional view of the locking package of FIG. 8 taken along the line 9—9.
Figure 10:
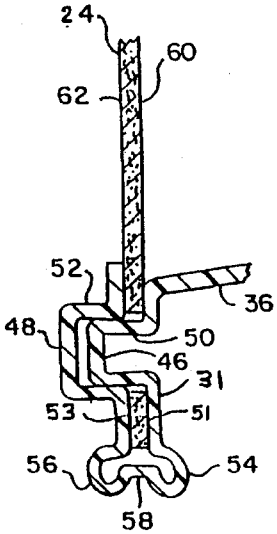
FIG. 10 is a detailed cross-sectional view of the hinged snap portion of the locking package as shown in FIG. 9.

A fully assembled locking package 20 in accordance with the present invention is shown in the several views of FIGS. 8–10, wherein like numerals refer to like parts throughout the several views. To assemble the locking package 20, the graphics card 24 is slid into the channels formed by the flanges 26, 27, and 28 of the product holding member 22 until the locking holes 64 and 65 are aligned with the raised portions of the snap locks 30 and 31. The card 24 will now rest against the back of the frame 41 of the product holding member 22. The snap locks 30 and 31 are then folded over at the hinge 44 such that the raised portions 46 and 48 are interlocked with one section engaging inside the other with the snap locks passing through the locking holes 64 and 65 of the graphics card 24. The resulting interlocked structure is shown in detail in FIG. 10. Note that the hinge separator section 58 leaves sufficient space between the hinge plates 51 and 53 such that the graphics card 24 is securely pinched between the hinge plates 51 and 53. The graphics card 24, therefore, is held securely in place by the flanges 26, 27, and 28 and the snap locks 30 and 31 without the need for gluing or sealing. A product placed in the product holding portion 36 of the product holding member 22 will be secured therein by the graphics card 24 which forms a back for the product holding portion 36.

Figure 11:
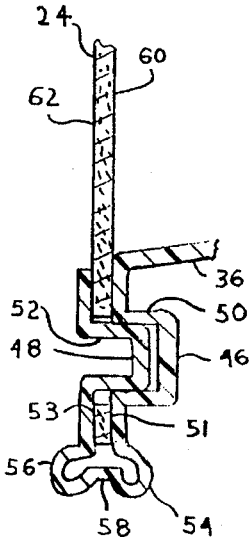
FIG. 11 is a detailed cross-sectional view of the hinged snap portion of an alternative embodiment of the locking package of the present invention.

A detailed cross-sectional view of the interlocked structure of an alternative embodiment of a locking package in accordance with the present invention is shown in FIG. 11. This figure illustrates the alternative embodiment of the present invention wherein the raised portions 46 and 48 of the snap lock are interchanged with respect to the faces 23 and 43 of the product holding member 22 as described above. The locking package of this embodiment is assembled in the same manner as described above. The graphics card 24 is slid into the channels formed by the flanges 26, 27, and 28 until the locking holes are aligned with the first raised portion 46. In this case, the locking holes are aligned with the cavity formed by the first raised portion 46. Since the graphics card does not have to be bent to slide over the raised portion 46, this embodiment of the locking package will typically be easier to assemble than the locking package previously described. When the snap lock is closed, the second raised portion 48 passes through the graphics card locking hole to secure the graphics card 24 to the product holding member 22 in the same manner as described above.

It is apparent that the method of assembling a locking package of the present invention has the advantage of not requiring special equipment for heat sealing or gluing. The entire face 60 of the graphics card 24 is also made available for decorations, as it will not be obscured by glue or deformed by heating. Moreover, the simple two piece structure of the locking package, including the premolded product holding member 22, doesn't require complex folding operations to be performed to form the package. The locking package 20 of the present invention may also be opened, by opening the snaps and sliding the card 24 from under the flanges 26, 27, and 28, without destroying the package 20, making re-closing and re-use of the package, and the demonstration to customers of a product contained in the package, a possibility. To more securely lock the hinged snaps 30 and 31, however, the interlocked raised portions 46 and 48 may be deformed, such as by crushing. The snaps 30 and 31 may also be ultrasonically sealed after they are closed.

It is understood that this invention is not confined to the particular construction and arrangement of parts herein illustrated and described, but embraces all such modified forms thereof as come within the scope of the following claims.

What is claimed is:

1. A locking package, comprising:

(a) a product holding member including a product holding portion, and a pair of flanges on opposite sides of the product holding member, each flange forming a channel for retaining a graphics card;

(b) a graphics card slid into the channels formed by the flanges and having an internal edge defining a locking hole; and (c) locking means for securing the graphics card to the product holding member to close the product holding portion to form a closed product holding chamber, the locking means being attached to the product holding member and including means for engaging the graphics card by passing through the locking hole, wherein the locking means is a hinged snap including a first raised snap portion and a second raised snap portion, the first and second raised snap portions separated by a snap hinge and arranged such that when the hinged snap is folded over at the snap hinge the first raised portion and Second raised portion are interlocked and a ode of the first or second raised portions passes through the graphics card locking hole to engage the graphics card.

2. The locking package of claim 1 wherein the product holding member is made of a semi-rigid clear plastic material.

3. The locking package of claim 1 wherein the flanges are folded over flanges formed by folded over edges of the product holding member to form the card retaining channels.

4. The locking package of claim 1 wherein the first and second raised snap portions include side walls which are tapered.

5. The locking package of claim 1 wherein the snap hinge includes a first bending section of the product holding member, a second bending section of the product holding member, and a snap hinge separator section between the first and second bending sections.

6. The locking package of claim 5 wherein the snap hinge separator section has a width which is approximately the same as a thickness of the graphics card.

7. The locking package of claim 1 wherein the graphics card is made of paperboard.

8. A locking package, comprising:

(a) a product holding member including a product holding portion, a pair of foldover flanges on opposite sides of the product holding member formed by folded over portions of the product holding member and forming a channel for retaining a graphics card on opposite sides of the product holding member, and a hinged snap lock including a first raised snap portion and a second raised snap portion, the first and second raised snap portions separated by a snap hinge and arranged such that when the hinged snap lock is folded over at the snap hinge the first raised portion and second raised portion are interlocked; and (b) a graphics card slid into the channels formed by the flanges and having an internal edge defining a locking hole and aligned with the first raised snap portion of the hinged snap such that the locking hole is engaged by the hinged snap lock by a one of the first or second raised portions passing through the locking hole to secure the graphics card to the product holding member to close the product holding portion to form a closed product holding chamber.

9. The locking package of claim 8 wherein the product holding member is made of semi-rigid clear plastic.

10. The locking package of claim 8 wherein the first and second raised snap portions include side walls which are tapered.

11. The locking package of claim 8 wherein the snap hinge includes a first bending section of the product holding member, a second bending section of the product holding member, and a snap hinge separator section between the first and second bending sections wherein the snap hinge separator section has a width which is approximately the same as a thickness of the graphics card.

12. The locking package of claim 8 wherein the graphics card is made of paperboard.

13. A product holding member for a locking package, comprising:

(a) a product holding portion;

(b) a pair of fold over flanges on opposite sides of the product holding member formed by folded over portions of the product holding member and forming graphics card retaining channels on opposite sides of the product holding member; and (c) a hinged snap lock including a first raised snap portion and a second raised snap portion, the first and second raised snap portions separated by a snap hinge and arranged such that when the hinged snap lock is folded over at the snap hinge the first raised portion and second raised portion are interlocked.

14. A product holding member for a locking package, comprising:

(a) a product holding portion;

(b) a pair of foldover flanges on opposite sides of the product holding member formed by folded over portions of the product holding member and forming graphics card retaining channels on opposite sides of the product holding member; and (c) a hinged snap lock including a first raised snap portion and a second raised snap portion, the first and second raised snap portions separated by a snap hinge and arranged such that when the hinged snap lock is folded over at the snap hinge the first raised portion and second raised portion are interlocked.

15. The product holding member of claim 13 wherein the first and second raised snap portions include side walls which are tapered.

16. The product holding member of claim 13 wherein the snap hinge includes a first bending section of the product holding member, a second bending section of the product holding member, and a snap hinge separator section between the first and second bending sections.

17. A method for assembling a locking package, comprising the steps of:

(a) providing a product holding member including a product holding portion, a pair of flanges on opposite sides of the product holding member, each flange forming a channel for retaining a graphics card, and a hinged snap lock including a first raised snap portion and a second raised snap portion, the first and second raised snap portions separated by a snap hinge and arranged such that when the hinged snap lock is folded over at the snap hinge the first raised portion and second raised portion are interlocked;

(b) providing a graphics card having an internal edge defining a locking hole;

(c) sliding the graphics card into the channels formed by the flanges such that the internal edge defining the locking hole is aligned with the first raised snap portion of the hinged snap of the product holding member and such that the product holding portion is closed to form a product holding chamber; and (d) folding over the hinged snap lock at the snap hinge to pass a one of the first or second raised snap portions through the locking hole and to interlock the first and second raised portions to secure the graphics card to the product holding member.

18. The method of claim 17 wherein the step of providing the product holding member includes the steps of cutting score lines near an outer edge of the product holding member and heating and folding the outer edge of the product holding member along the score lines to form the flanges.

19. The method of claim 17 including additionally the step of crushing the first and second raised portions after they are interlocked.

* * * * *

UNITED STATES PATENT AND TRADEMARK OFFICE

CERTIFICATE OF CORRECTION

PATENT NO. : 5,593,036

DATED : January 14, 1997

INVENTOR(S) : Richard J. Dyble, et al.

It is certified that error appears in the above-indentified patent and that said Letters Patent is hereby corrected as shown below:

In column 7, line 31 of the patent, "Second" should be --second--.

In column 7, line 31 of the patent, "ode" should be --one--.

In column 8, line 25 of the patent, "fold over" should be --foldover--.

In column 8, lines 36 through 49 (claim 14) should be deleted and the following inserted --14. The product holding member of Claim 13 wherein the product holding member is made of semi-rigid clear plastic.--

Signed and Sealed this

Thirtieth Day of June, 1998

*Attest:*

*Attesting Officer*

Bruce Lehman

BRUCE LEHMAN

*Commissioner of Patents and Trademarks*